US005836470A

United States Patent [19]

Neelly et al.

[11] Patent Number: 5,836,470

[45] Date of Patent: Nov. 17, 1998

[54] TRASH RECEPTACLE WITH EXPANDABLE RIM

[75] Inventors: Michael L. Neelly, 49 Briggsboro La., Fairport, N.Y. 14450; Raymond Flo, Canandaigua, N.Y.; Kathryn E. Alexander; Bill Russell Alexander, both of Columbus, Ohio

[73] Assignee: Michael L. Neelly, Fairport, N.Y.

[21] Appl. No.: 814,086

[22] Filed: Mar. 10, 1997

[51] Int. Cl.[6] ..... B65D 1/06

[52] U.S. Cl. ..... 220/4.22; 220/6; 220/404; 220/908

[58] Field of Search ..... 220/404, 908, 220/6, 4.22, 4.24, 4.21, 23.9, 495.11, 908.1

[56] References Cited

U.S. PATENT DOCUMENTS

| | | | |
|---|---|---|---|
| D. 300,973 | 5/1989 | Copeland . | |
| D. 327,348 | 6/1992 | Skorheim . | |
| D. 337,189 | 7/1993 | Moder . | |
| 1,866,316 | 7/1932 | Miller | 220/404 |
| 3,063,591 | 11/1962 | Laginestra | 220/908 |
| 3,195,272 | 7/1965 | Mosher et al. | 220/4.24 |
| 3,613,566 | 10/1971 | Shapleigh, Jr. et al. | 220/404 |
| 4,444,355 | 4/1984 | Cary . | |
| 4,487,331 | 12/1984 | Hawker . | |
| 4,664,347 | 5/1987 | Brown et al. . | |
| 4,763,808 | 8/1988 | Gahl et al. . | |
| 4,917,263 | 4/1990 | Korb . | |
| 4,951,831 | 8/1990 | Roesch et al. . | |
| 4,953,740 | 9/1990 | Koda . | |
| 4,989,749 | 2/1991 | Choi . | |
| 5,056,679 | 10/1991 | Lonczak . | |
| 5,160,063 | 11/1992 | Bailey . | |
| 5,222,536 | 6/1993 | Hodgdom et al. . | |
| 5,361,978 | 11/1994 | Monroe | 220/908 |
| 5,372,269 | 12/1994 | Sutton et al. . | |

FOREIGN PATENT DOCUMENTS

| | | | |
|---|---|---|---|
| 20 36 310 | 12/1970 | France | 220/908 |
| 1640057 | 4/1991 | U.S.S.R. | 220/908 |
| 870058 | 6/1961 | United Kingdom | 220/4.22 |
| 2 246 558 | 2/1992 | United Kingdom | 220/4.22 |

*Primary Examiner*—Stephen J. Castellano
*Attorney, Agent, or Firm*—Cumpston & Shaw

[57] ABSTRACT

A trash receptacle including a container having a variable upper periphery to hold the opening of a plastic trash bag in tension and to ease the removal of a full bag of trash from the container. In one embodiment, the container has a peripheral frame having spaced apart ribs or protrusions, a slider bar mating with the spaced apart protrusions, a spring disposed intermediate the frame the slider bar to urge the slider bar away from the frame, thereby holding a plastic trash bag in a secure and open position within the trash receptacle. In another embodiment, a vertical section of the container is biased away from the main body of the container by gravity or springs. Thus, when the bag is placed within the container and wrapped around the lip of the container, the upper periphery of the vertical section is biased away from the upper periphery of the main body to hold the opening of the trash bag in tension.

14 Claims, 8 Drawing Sheets

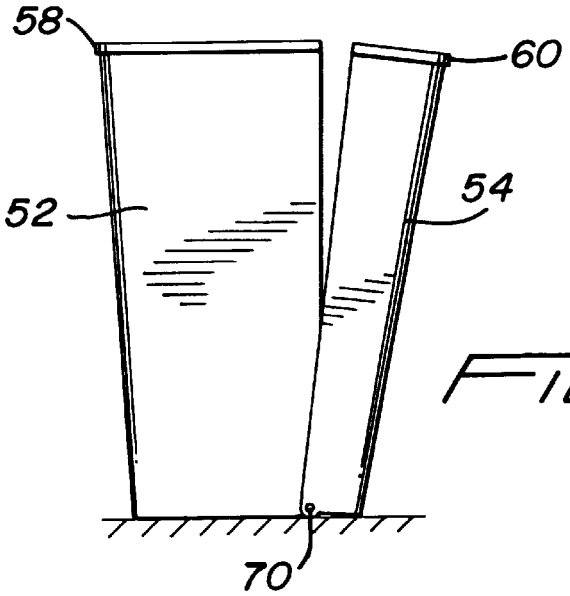
FIG. 9
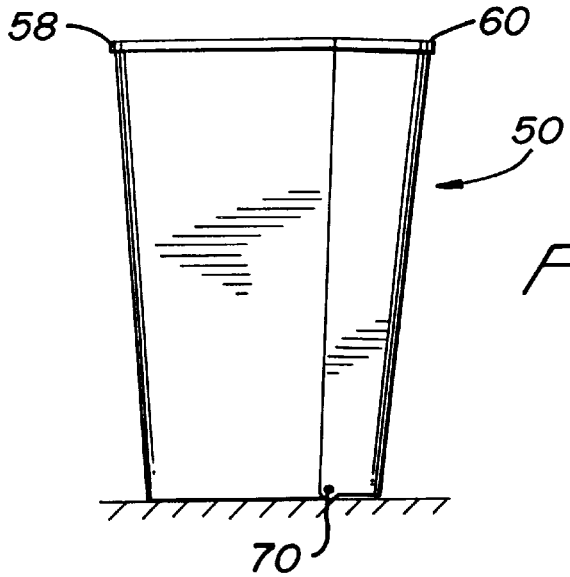
FIG. 10
FIG. 11
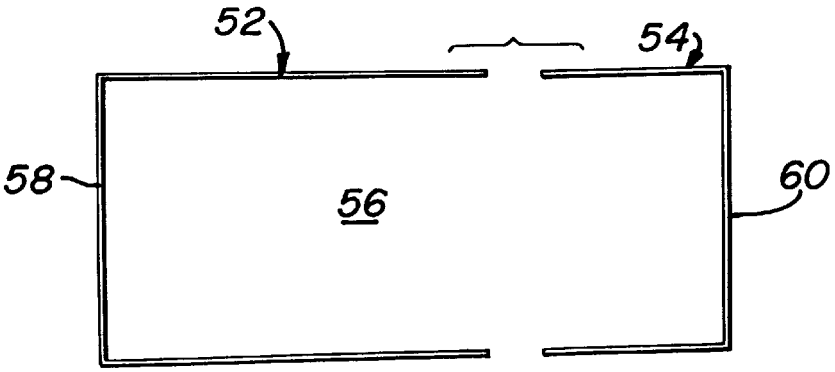

TRASH RECEPTACLE WITH EXPANDABLE RIM

FIELD OF THE INVENTION

The present invention relates to a waste basket or trash receptacle, in particular to a trash receptacle for holding and retaining plastic trash bags and for easing the removal of bags full of trash from the receptacle.

BACKGROUND OF THE INVENTION

In previous years trash baskets were provided as a simple container or basket, usually rectangular in shape. The trash containers or receptacles were placed in kitchens and elsewhere; usually a paper grocery bag was placed in the basket for receiving waste for disposal. In recent years, commercial plastic bags were introduced for sale, which the open ends of the bags are folded over the rims of the baskets to hold the bags open. However, the tops of the plastic bags do not necessarily stay attached to the top rim of the trash receptacle. One or more sides of the plastic trash bag tend to fall into the trash receptacle, thereby inhibiting the use of the plastic trash bag and allowing garbage to contaminate the trash receptacle itself. Additionally, when the bags are full of trash they are difficult to remove from the container.

Various devices have been commercially available for assisting and holding the plastic trash bag open while it is situated in a trash receptacle. A number of metal and plastic "frame" type supports have come on the market but are not popular. These frame supports tend to be awkward and unstable, tending to hold the bags poorly and allowing the bags to fall into the container when in use. In addition, these frame supports tend to collapse and fall apart while in use, and tend to tear or punch holes into the trash bags.

Attachments have been invented to hold the plastic bags onto trash receptacles. Some examples of the devices are interior vanes, elaborate foot operating actuating mechanisms for opening and closing the lid and securing the plastic bag in an open position, and expandable and retractable leg supports. However, these inventions do not have optimum simplicity, reliability, economy, etc.

SUMMARY OF THE INVENTION

The present invention provides a trash receptacle for use with a plastic trash bag. In one embodiment, the trash receptacle or refuse collector for use with a trash bag comprises a container defining a first periphery; a slider bar cooperating with the container to define a second periphery, and a spring disposed intermediate the container and the slider bar to urge the slider bar away from the can. In this manner, when the open end of the trash bag is wrapped around the first and second peripheries, the bag will be held in an open and secure position. In other embodiments, a vertical section of the trash receptacle or refuse collector is biased away from the remainder of the receptacle by gravity or springs so that the open end of a trash bag wrapped around the lip of the receptacle is held open.

BRIEF DESCRIPTION OF THE DRAWINGS

FIG. 9 is a side view of the trash receptacle of FIG. 8;

FIG. 10 is a side view of the trash receptacle of FIG. 8 with bag installed;

FIG. 11 is a top view of the trash receptacle of FIG. 8;

DETAILED DESCRIPTION OF THE PREFERRED EMBODIMENT

Figure 1:
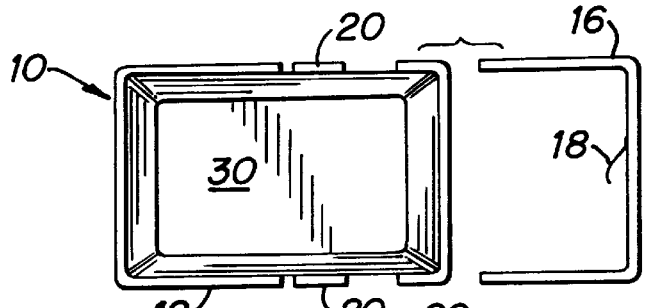
FIG. 1 is a top view of the trash receptacle in accordance with one embodiment of the present invention.
Figure 2:
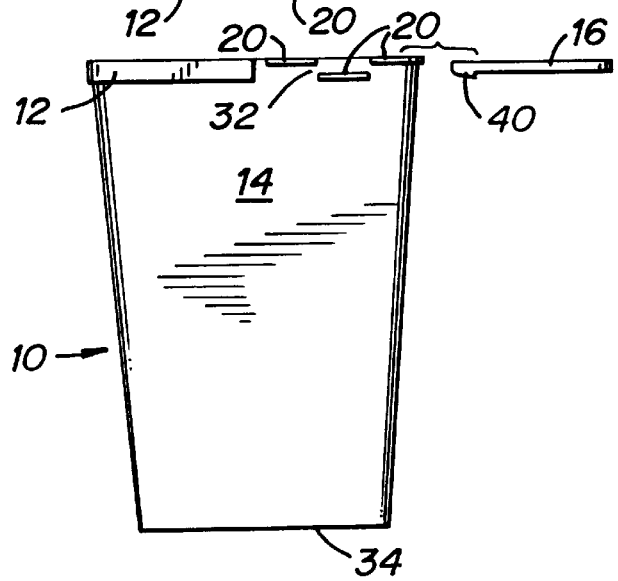
FIG. 2 is a side view of the trash receptacle shown in FIG. 1.
Figure 3:
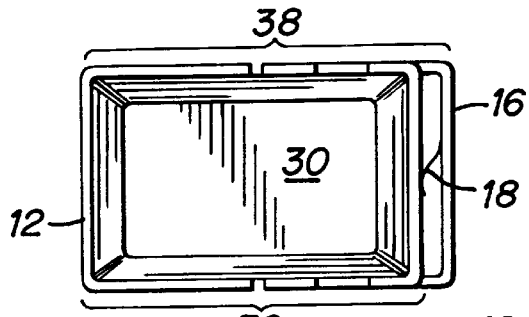
FIG. 3 is a top view of the trash receptacle of FIG. 1 in an operative position.
Figure 4:
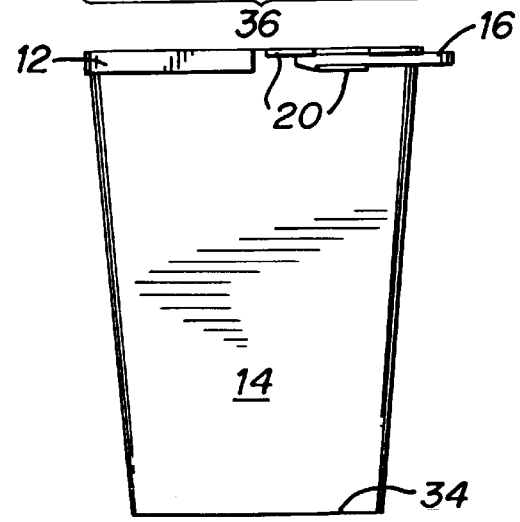
FIG. 4 is a side perspective view of the trash receptacle shown in FIG. 3.
Figure 5:
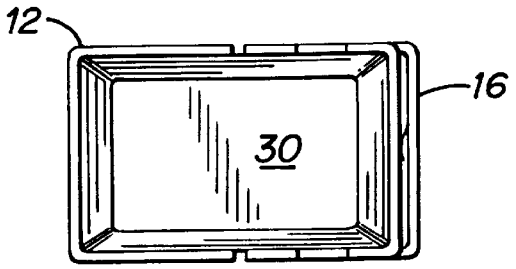
FIG. 5 is a top view of the trash receptacle of FIG. 1 with bag installed.
Figure 6:
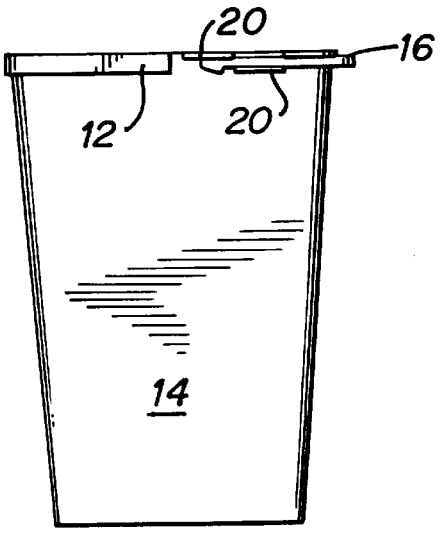
FIG. 6 is a side view of the trash receptacle shown in FIG. 5.
Figure 7:
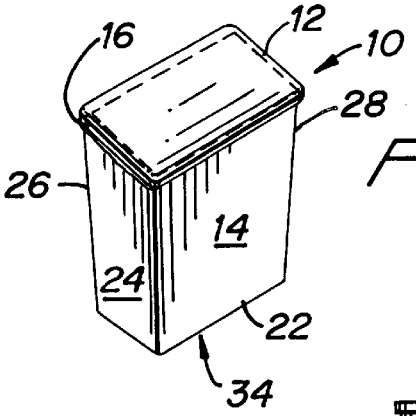
FIG. 7 is a perspective view of the trash receptacle of FIG. 1.

Referring initially to FIGS. 1–6 of the drawings, it will be seen that a waste basket or a trash receptacle 10 formed in accordance with a first embodiment of the present invention includes a container 14 having an open end 30, a rigid peripheral frame 12, a slider bar 16 and a spring 18. As shown in FIG. 7, the container 14 itself preferably has four side walls 22, 24, 26, and 28 and a bottom 34. As shown in FIG. 1, the rigid peripheral frame 12 surrounds the upper portion of the trash receptacle 10. The rigid peripheral frame 12 defines an opening 30 and also includes at least one spaced apart rib 20 along a portion of its frame 12. The spaced ribs 20 are spaced in a parallel relationship with the top of the container 14 to mate with the interlocking slider bar 16. Slider bar 16 is inserted through the ribs 20 and into the rigid peripheral frame 12 in a parallel direction with the top of the receptacle 10. A spring 18 is disposed intermediate the frame 12 and the slider bar 16, urging the slider bar 16 away from the frame 12. Preferably, the slider bar 16 includes a locking edge 40 which inhibits the slider bar from automatically releasing from the ribs 20 without additional manipulation. As shown in FIGS. 3 and 4, upon insertion of the slider bar 16 through the spaced apart ribs 20, the spring 18 biases against the frame 12 to urge the bar 16 away from the frame 12. As shown in FIGS. 5, 6 and 7, when inserting the trash bag (not shown), the slider bar 16 is directed toward the frame 12 to allow a trash bag (not shown) to be fitted over the rigid frame 12 and the slider bar 16. Once the trash bag is fitted over the frame 12 and bar 16, an individual may release the slider bar 16, thereby allowing the spring 18 to urge the slider bar 16 away from the frame 12 thereby holding the plastic trash bag in a secure and open fashion.

Alternatively, as shown in FIG. 3, the trash receptacle 10 comprises a container 14 having a rigid frame 12, defining a first periphery 36. The slider bar 16 cooperates with the container 14 and the frame 12 to define a second periphery 38, preferably a larger periphery than the first periphery 36. The spring 18, disposed intermediate the container 14 and the slider bar 16, urges the slider bar 16 away from the container 14. A further embodiment, as shown in FIG. 2 and 4, includes at least one pair of parallel, spaced apart ribs 20 provided on the trash receptacle 14 in the same horizontal plane as frame 12 with a first periphery 36. The ribs 20 straddle a corresponding slot 32 formed in the peripheral frame 12. The slider bar 16 correspondingly mates with the spaced apart ribs 20 to form a second expandable periphery 38. The spring 18 is disposed intermediate the frame 12 and slider bar 16, urging the slider bar 16 away from the frame 12. The trash bag is fitted over the frame 12 and bar 16. As shown in FIG. 5 and FIG. 7, the spring 18 biases the bar 16 away from the frame 12 and keeps the plastic bag open.

Figure 8:
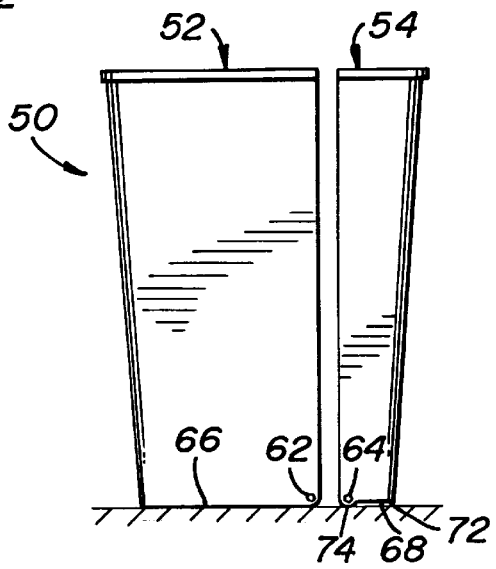
FIG. 8 is a side view of the components of a trash receptacle in a second embodiment of the invention.

As shown in FIGS. 8–10, a second embodiment of the present invention is shown. The trash receptacle 50 comprises a main can 52 and a swing side 54. The receptacle 50 has an upper periphery defining the open end 56 as shown in FIG. 11. The upper periphery is defined by the periphery 58 of the main can 52 and the periphery 60 of the swing side 54. The swing side 54 may be attached to the main can 52 as follows. The main can 52 may be provided with a protruding molded-in pin 62 near each comer of the bottom end 66 which faces the swing side 54. The swing side 54 may likewise be provided with a molded-in hole 64 near each comer of the bottom end 68 which faces the main can 52. Thus, the swing side 54 may be attached to the main can 52 by pressing the pins 62 into the holes 64. Alternatively, the pins 62 may be provided on the swing side 54 and the holes 64 may be provided on the main can 52. Also alternatively, the pins 62 may be separate from the receptacle 50 and made from metal, plastic, or another suitable material. A pivot point 70 is created by the pins 62 inserted into the holes 64. The swing side 54 of the receptacle 50 is a vertical section of the receptacle 50. In other words, when the swing side 54 is swung towards the main can 52 at the pivot point 70, the main can 52 and the swing side 54 meet to form a complete receptacle 50 with a substantially uninterrupted periphery.

As shown in FIG. 8, the bottom end 68 of the swing side 54 is provided with two vertically displaced levels which are preferably both parallel with the periphery 60. A first level 72 comprises a main portion of the bottom end 68. A second level 74 is vertically lower than the first level 72 and spaced slightly further than the first level 72 from the periphery 60. The holes 64, or in an alternate embodiment the pins 62, are located on the side of the swing side 54 adjacent the second level 74. When the receptacle 50 is assembled as shown in FIG. 9, the swing side 54 and the main can 52 meet at pivot point 70. Because the first level 72 of the bottom end 68 of the swing side 54 is not level with the bottom end 66 of the main can 52, the swing side 54 tilts via gravity about pivot point 70 away from main can 52. The receptacle as shown in FIG. 9 is ready to accept a trash bag. In operation, a user would place the bottom end of a trash bag (not shown) within the receptacle 50. Then, the user would hook one side of the open end of the trash bag around the periphery 60 of the swing side 54 and use the bag to pull the swing side 54 towards the main can 52. Then, the user would hook the other side of the open end of the bag over the periphery 58 of the main can 52, such that the receptacle 50 will assume the position as shown in FIG. 10 (bag not shown). The swing side 54 is forced by gravity away from the main can 52 and thus the bag is held by tension at the top of the receptacle 50. As shown in FIG. 9, if no bag is installed or the bag is removed, the floor or ground prevents the swing side 54 from swinging unduly far.

Figure 12:
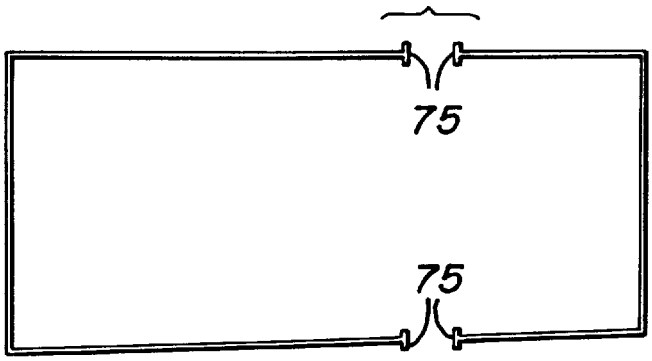
FIG. 12 is a top view of an alternate embodiment of the trash receptacle of FIG. 8.
Figure 13:
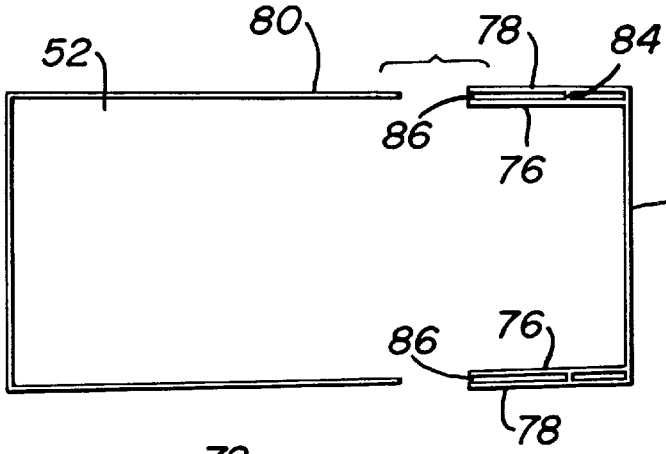
FIG. 13 is a top view of an alternate embodiment of the trash receptacle of FIG. 8.
Figure 14:
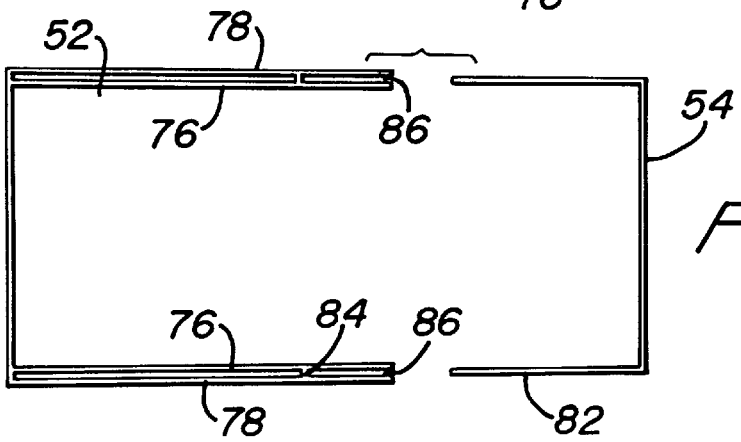
FIG. 14 is a top view of an alternate embodiment of the trash receptacle of FIG. 8.

As shown in FIG. 11, when the periphery 60 of the swing side 54 is swung to meet the periphery 58 of the main can 52, the ends of the U-shaped peripheries may simply abut. As shown in FIG. 12, platforms 75 may be provided at the ends of the peripheries so as to prevent the periphery 60 of the swing side 54 and the periphery 58 of the main can 52 from overlapping. Alternatively, as shown in FIGS. 13 and 14, either the swing side 54 or the main can 52 could be provided with double walls so as to provide a slot for the other side. Such an embodiment provides greater adjustability with respect to the size of the opening 56 of the receptacle 50. The swing side 54, as shown in FIG. 13, or the main can 52, as shown in FIG. 14, is provided with a pair of inner walls 76 spaced apart from a pair of outer walls 78 to form slots 86. The width of the slots 86 is large enough to accept the thickness of the wall 80 of the main can 52 or the wall 82 of the swing side 54. In order to prevent the swing side 54 from swinging too far towards the main can 52, stoppers 84 may be provided within the slots 86.

Figure 15:
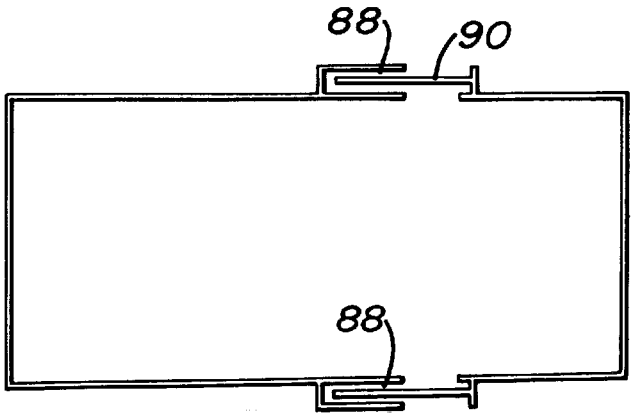
FIG. 15 is a top view of an alternate embodiment of the trash receptacle of FIG. 8.
Figure 16:
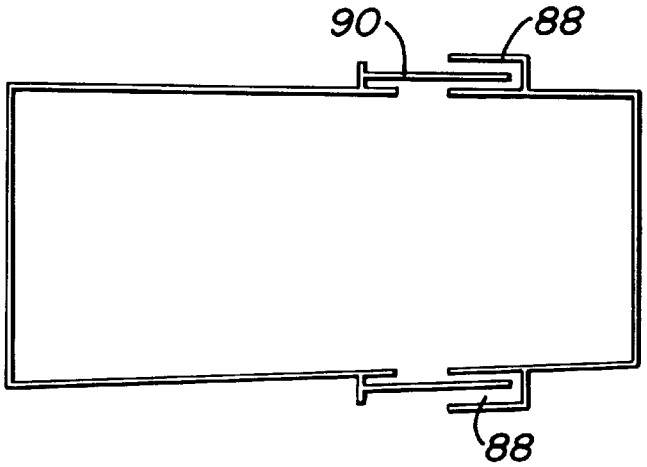
FIG. 16 is a top view of an alternate embodiment of the trash receptacle of FIG. 8.
Figure 17:
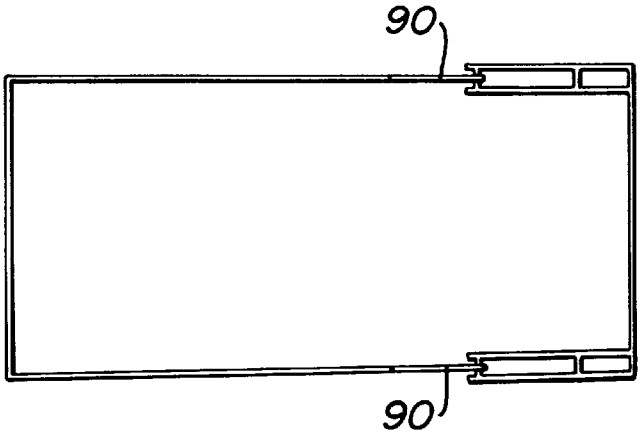
FIG. 17 is a top view of an alternate embodiment of the trash receptacle of FIG. 8.

As shown in FIGS. 15 and 16, an alternate embodiment for mating the ends of the peripheries 58 and 60 is shown which eliminates the need for double walls, thus reducing the expense of materials needed to make the receptacle 50. Pockets 88 may be provided on the exterior of the main can 52 as shown in FIG. 15 or on the exterior of the swing side 54 as shown in FIG. 16. Guide rods 90 positioned on the exterior of the swing side 54 as shown in FIG. 15 or on the exterior of the main can 52 as in FIG. 16 are positioned to slide in and out of pockets 88. Pockets 88 need only be as long as guide rods 90 and need only be wide enough to accommodate the guide rods 90 during the angular displacement which occurs when the swing side 54 is swung away from the main can 52 as shown in FIG. 9. The guide rods 90 may be positioned partially within pockets 88 even when there is no bag within receptacle 50 so that the swing side 54 pivots smoothly and evenly relative to the main can 52. As shown in FIG. 17, guide rods 90 may also be incorporated into the slotting embodiment of FIGS. 13 and 14.

Figure 18:
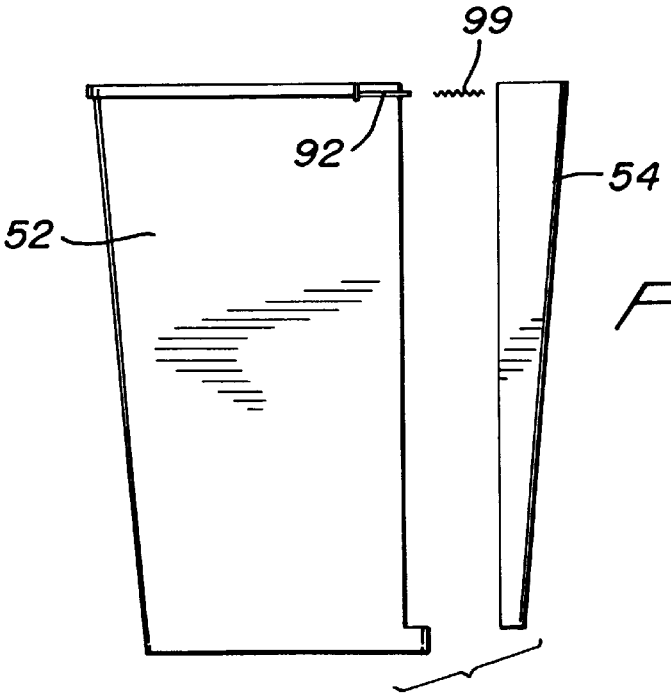
FIG. 18 is a side view of another embodiment of the trash receptacle of the present invention.
Figure 19:
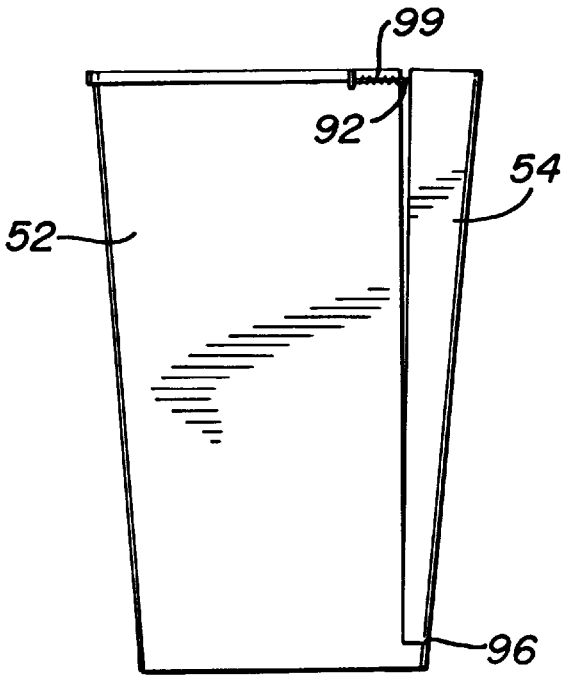
FIG. 19 is a side view of the trash receptacle of FIG. 18.
Figure 20:
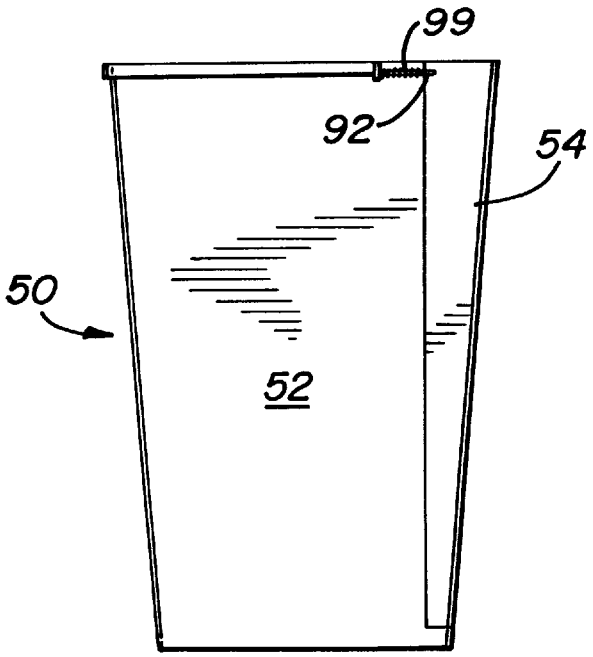
FIG. 20 is a side view of the trash receptacle of FIG. 18 with bag installed.

The embodiments shown in FIGS. 8–17 use gravity to force the swing side 54 away from the main can 52. An alternative means for forcing the swing side 54 away from the main can 52 may be found in the use of springs. As shown in FIGS. 18–20, for example, the main can 52 may be provided with an integrally molded or separately attached pin 92 on both sides of the periphery 58 facing the swing side 54. Springs 94, longer than the pins 92, are placed over the pins 92. The swing side 54 is attached to the main can 52 by one or more hinges 96. Alternatively, if the receptacle 50 and the swing side 54 are not too large, the swing side 54 may be integrally molded with the main can 52 and provided with a living hinge at the location of hinges 96. The top of the swing side 54 is attached to the main can 52 such as by snapping the swing side 54 onto the pins 92. During the attachment of the swing side 54 to the main can 52, the springs 94 must be compressed. Thus, as shown in FIG. 19, the springs 94 will bias the top of the swing side 54 away from the main can 52. As in the previous embodiments, during operation, a user will hook one side of the open end of a trash bag around the periphery 60 of the swing side 54 and use the bag to pull the swing side 54 towards the main can 52. Then, the user will hook the other side of the open end of the bag over the periphery 58 of the main can 52, such that the receptacle 50 will assume the position as shown in FIG. 20 (bag not shown). The swing side 54 is forced by the springs 94 away from the main can 52 and thus the bag is held by tension at the top of the receptacle 50. As shown in FIG. 19, if no bag is installed or the bag is removed, the swing side 54 is prevented from swinging unduly far by the attachment to pins 92.

Figure 21:
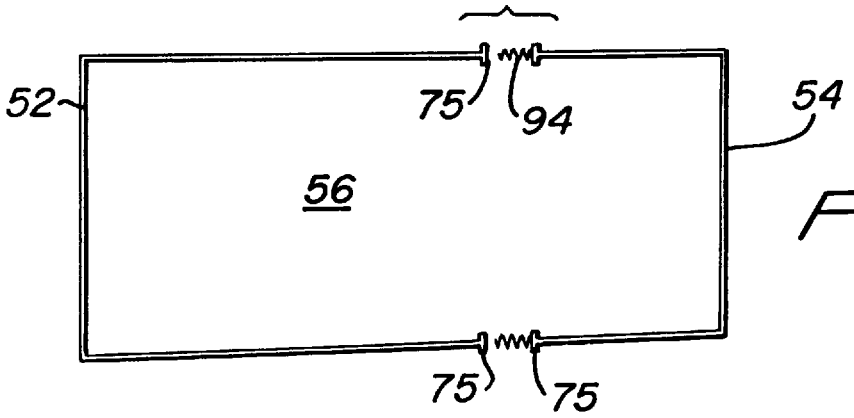
FIG. 21 is a top view of an alternate embodiment of the trash receptacle FIG. 18.

In an alternate embodiment, as shown in FIG. 21, the swing side 54 (or alternatively, the main can 52), could be provided with the springs 94 while the main can 52 (or alternatively, the swing side 54) is provided with platforms 75. In this embodiment, when the main can 52 abuts with the swing side 54, the springs 94 must be compressed to reduce the size of the opening 56. Thus, when a bag is wrapped around the top peripheries of the main can 52 and the swing side 54, the platforms 75 abut with and compress the springs 94. The swing side 54 is biased away from the main can 52 by the springs' tendency to decompress and thus the top of a bag wrapped around the receptacle 50 is held in tension.

Figure 22:
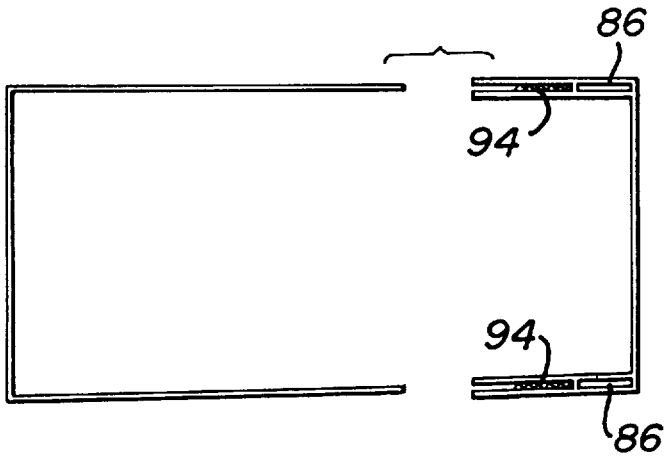
FIG. 22 is a top view of another alternate embodiment of the trash receptacle of FIG. 18.
Figure 23:
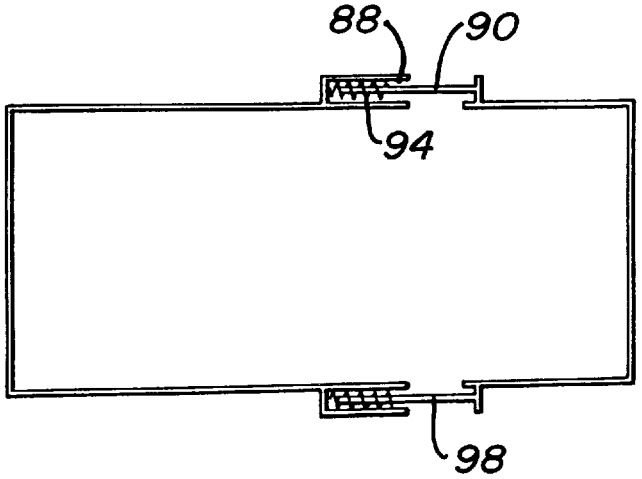
FIG. 23 is a top view of another alternate embodiment of the trash receptacle of FIG. 18.

In another alternate embodiment, as shown in FIG. 22, either side of the receptacle 50 could be provided with double walled slots 86 as shown in FIGS. 13 and 14. Springs 94 may then be inserted within the slots 86 such that when the walls 80 or 82 are inserted into the slots 86 they are pushed in an outward direction by the springs 94. In yet another alternate embodiment, as shown in FIG. 23, either side of the receptacle 50 could be provided with pockets 88 while the opposite side is provided with guide rods 90 as shown in FIGS. 15 and 16. Springs 94 may then be inserted within the pockets 88 such that when after a portion of the guide rod 90 is inserted into a pocket 88 it is pushed in an outward direction by the springs 94. The portion of the guide rod 90 at which the springs 94 begin to push it in an outward direction may be defined by a landing 98 positioned about the rod 90 so as to provide a flat surface for the springs 94 to push against.

Figure 24:
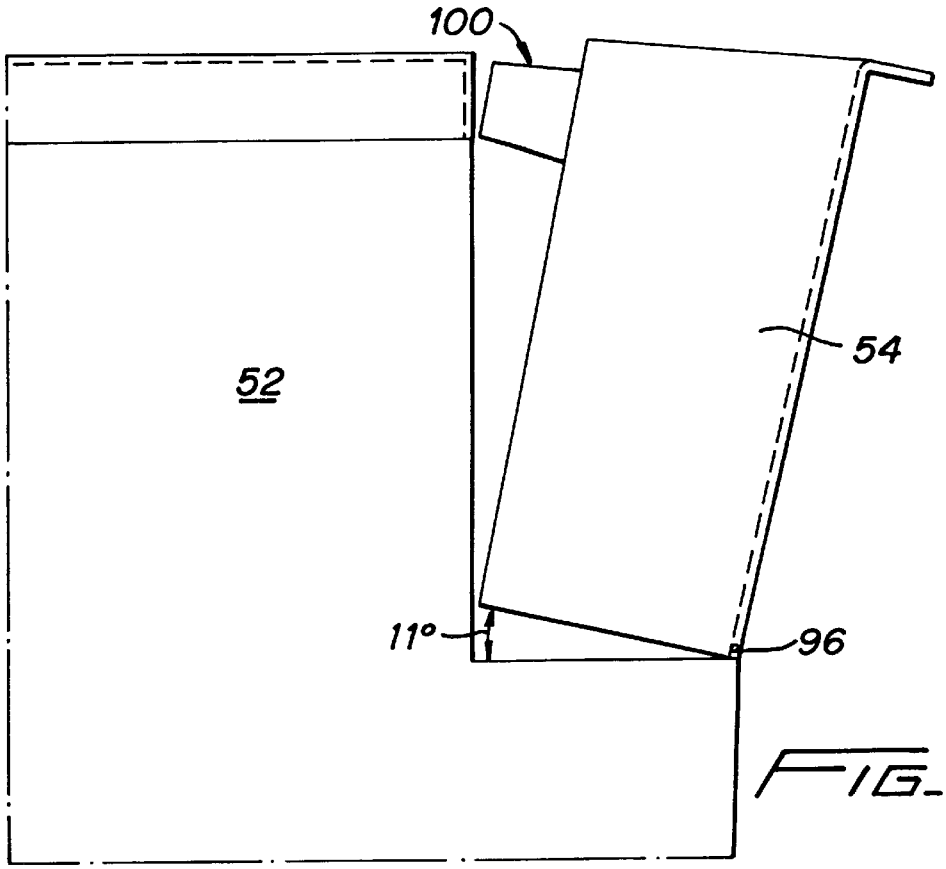
FIG. 24 is a side view of an alternate embodiment of the trash receptacle of FIG. 18.
Figure 25:
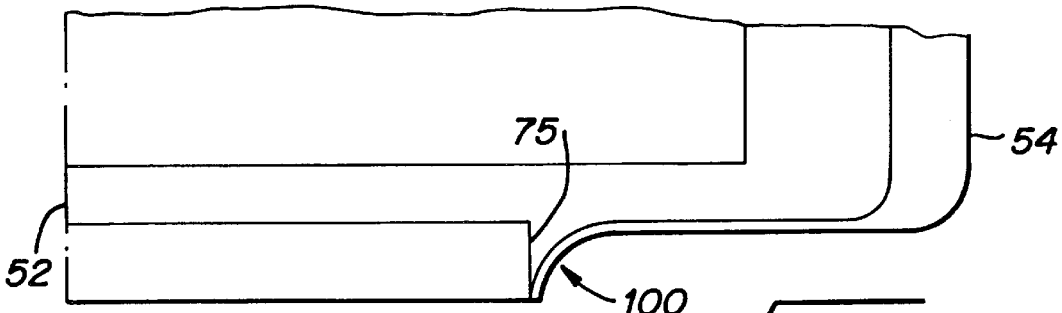
FIG. 25 is a partial top view of the trash receptacle of FIG. 24.

In another alternate embodiment, as shown in FIGS. 24 and 25, a flat spring could be used in place of the coiled compression springs 94 described in the previous embodiments. As shown in FIG. 24, the swing side 54 is biased away from the main can 52 by springs 100 which may be molded with the swing side 54. When the swing side 54 is drawn closer to the main can 52 by an overlapping trash bag, the springs 100 may be pressed against platforms 75 located on main can 52. When a trash bag is installed, the springs 100 will push against the platforms 75 to bias the swing side 54 away from the main can 52, thus holding the bag in tension. A spring retention feature may be used at hinge 96 to prevent the swing side 54 from flopping down when a bag is removed or not installed.

Figure 26:
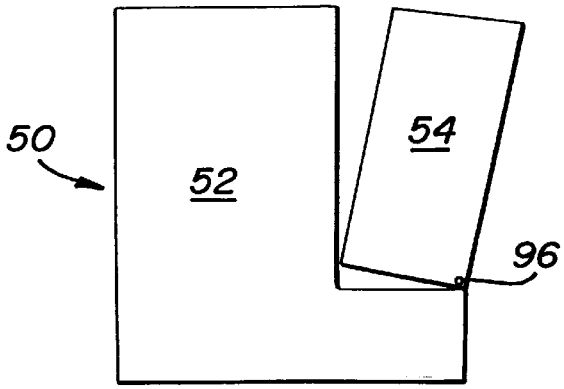
FIG. 26 is a side view of an alternate embodiment of the trash receptacle of FIG. 18.

Although illustrative embodiments of the present invention have been described herein with reference to the accompanying drawings, it is to be understood that the invention is not limited to those precise embodiments, and that various modifications and changes may be affected therein by one skilled in the art without departing from the scope or spirit of the invention. For example, although the hinged receptacles shown in FIGS. 8–10 and 18–20 are shown with swing sides 54 which comprise all or nearly all of an entire vertical section of the receptacle 50, the swing side 54 of the receptacle 50 may instead take up only a portion of a vertical section of the receptacle as shown in FIG. 26. In addition, the swing sides 54 may be of any width up to 50% of the receptacle's width. Also, the hinges used on the described embodiments may be mechanical or living, and the receptacles can be of any size or shape. Although the receptacles shown have a rectangular perimeter, other perimeters such as round or oval are possible. Other modifications and variations can be made to the disclosed embodiments without departing from the subject of the invention as defined in the following claims.

We claim:

1. A trash receptacle having an upper periphery defining an open end, the receptacle comprising:

(a) a main body, the main body having a base and a side, the side including an upper periphery which comprises a portion of the upper periphery of the receptacle;

(b) a secondary body pivotally attached to and biased away from the main body, the secondary body having a bottom and a second side, the secondary side including an upper periphery which when combined with the upper periphery of the main body forms the upper periphery of the receptacle;

(c) the bottom having a first level spaced a first distance from the upper periphery of the secondary body and a second level, parallel to the first level and spaced a second distance, greater than the first distance, from the upper periphery of the secondary body, the secondary body hinged to the main body adjacent the second level.

2. The trash receptacle of claim 1 in which the secondary body is biased away from the main body by gravity.

3. The trash receptacle of claim 1 in which the secondary body is biased away from the main body by at least one spring.

4. The trash receptacle of claim 1 in which the at least one spring is a flat spring.

5. The trash receptacle of claim 3 in which the at least one spring is a coiled spring.

6. The trash receptacle of claim 3 in which the at least one spring is attached to the upper periphery of the main body.

7. The trash receptacle of claim 3 in which the at least one spring is attached to the upper periphery of the secondary body.

8. The trash receptacle of claim 1 in which one of the main body or secondary body has is formed with two pockets and the other of the main body or secondary body is formed with two guide rods.

9. The trash receptacle of claim 1 in which one of the main body or secondary body has double walls to form slots.

10. The trash receptacle of claim 1 in which at least one of the main body or secondary body has an enlarged sidewall forming a platform.

11. The trash receptacle of claim 8 in which the biasing means is a pair of springs and the springs are in the pockets.

12. The trash receptacle of claim 9 in which the biasing means is a pair of springs and the springs are in the double walls.

13. The trash receptacle of claim 1 in which the main body and the secondary body each have a substantially U-shaped cross-section.

14. The trash receptacle of claim 1 in which the upper periphery of the trash receptacle is variable.

* * * * *